United States Patent [19]

Knight

[11] Patent Number: 4,697,396

[45] Date of Patent: Oct. 6, 1987

[54] UTILITY POLE SUPPORT

[75] Inventor: John K. Knight, Doncaster, Australia

[73] Assignee: R.F.D. Consultants Pty. Ltd., Victoria, Australia

[21] Appl. No.: 691,189

[22] PCT Filed: May 4, 1984

[86] PCT No.: PCT/AU84/00075

§ 371 Date: Dec. 18, 1984

§ 102(e) Date: Dec. 18, 1984

[87] PCT Pub. No.: WO84/04348

PCT Pub. Date: Nov. 8, 1984

[30] Foreign Application Priority Data

May 4, 1983 [AU] Australia ..... PF9168
Jul. 27, 1983 [AU] Australia ..... PG0518

[51] Int. Cl.[4] ..... E02D 27/42

[52] U.S. Cl. ..... 52/170; 52/295; 52/514; 52/728

[58] Field of Search ..... 52/155, 158, 165, 170, 52/514, 742, 728, 294, 297, 295

[56] References Cited

U.S. PATENT DOCUMENTS

| | | | |
|---|---|---|---|
| 1,726,371 | 8/1929 | Spring | 52/170 |
| 1,811,899 | 6/1931 | Spring | 52/170 |
| 1,995,874 | 3/1935 | Van De Mork | 52/728 |
| 2,090,972 | 8/1937 | Allen | 52/170 |
| 2,176,530 | 10/1939 | Greulich | 52/170 |
| 2,265,452 | 12/1941 | Ruggieri | 52/170 |
| 2,327,681 | 8/1943 | Vanderveer | 52/728 |
| 2,335,227 | 11/1943 | Baron | 52/40 X |
| 2,358,343 | 9/1944 | Maxey | 52/40 |
| 3,309,824 | 3/1967 | Barrett | 52/170 |
| 3,320,714 | 5/1967 | Barrett | 52/170 |
| 3,350,822 | 9/1965 | Nachazel | 52/170 |
| 3,625,463 | 12/1971 | Scholz | 248/221 |
| 3,662,505 | 5/1972 | Watanabe et al. | 52/165 |
| 3,738,072 | 6/1973 | Adrian | 52/170 |
| 3,785,107 | 1/1974 | Garretson | 52/514 |
| 3,903,662 | 9/1975 | Gabliya et al. | 52/742 |
| 4,516,365 | 5/1985 | Chapman | 52/170 |

FOREIGN PATENT DOCUMENTS

| | | | |
|---|---|---|---|
| 819575 | 7/1949 | Fed. Rep. of Germany . | |
| 269511 | 11/1929 | Italy | 52/170 |

OTHER PUBLICATIONS

World Intelectual Property Organization, PCT/SE82/00080, A Concrete Foot-Structure for Posts or a Concrete-Post Plinth having a Fracture Mechanism Cast therein; and a Method for Manufacturing Such a Foot Structure or Plinth, published 9/30/82.

*Primary Examiner*—John E. Murtagh
*Assistant Examiner*—Andrew Joseph Rudy
*Attorney, Agent, or Firm*—Stetina and Brunda

[57] ABSTRACT

A utility pole support (42) for repairing or strengthening a damaged or broken utility pole (2) including a first part (44) which is securely fastened to the pole above ground level in use and a second part (46) which is so shaped to be driven into the ground against the surface of the pole under the ground in use to provide support around the weakened part (10) of the pole, the support being retained in place below ground level by the action of the earth against the pole support.

19 Claims, 15 Drawing Figures

UTILITY POLE SUPPORT

The present invention relates to a device and method for reinforcing utility poles and the like, and more particularly, to strengthening utility poles that have been weakened such as by weathering or corrosion.

Although the present invention will be described with particular reference to repairing rotted wooden utility poles such as wooden telegraph poles, power poles, light poles and the like, by providing additional support about the region of rotting by means of a supporting element attached to the pole, it is to be noted that the scope of the invention is not so limited and it may extend further so as to be applicable to providing support for any type of pole or similar structure whatever material the structure may be made from. Thus, the word pole as used in the present specification is not limited to utility poles but includes within its scope other structural elements, such as for example, poles used in foundations, towers, masts, stumps, pylons, pier supports and the like.

One problem associated with wooden utility poles that have been in the ground for long periods of time is that rotting takes place in the region of ground level, both above and below the surface of the ground. The remainder of the pole may be in good condition both above and below the rotted region, and the pole generally sound apart from the relatively small region of rot around about ground level. Although the pole is rotted at a small area only, it is structurally weakened and hence, must be repaired or replaced. To overcome the relative high cost, in terms of time, labour and material, of replacing the pole entirely, various attempts have been proposed in order to repair or renovate the pole. Such attempts to have not always been entirely satisfactory for a number of reasons associated with the cost, the degree of difficulty, length of time taken to perform the process and the like.

Therefore, it is an aim of the present invention to attempt to overcome at least some of the problems of prior art devices and methods by providing an elegantly simple support member for and a method of repairing or renovating damaged poles.

An elongate support member for providing added strength to a pole having a weakened or damaged portion by being connected to a part of the pole so a to be aligned along the lengthwise extending axis of the pole characterised in that the support member comprises a first portion which extends to one side of the damaged or weakened portion having a flange which is provided with means to effect fastening of the support member to the pole in use, and a second portion extending to the other side of the damaged or weakened portion being of a reduced width or thickness for facilitating entry into a substrate in which the pole is positioned in use, the support member being held in abutting relationship with the pole in use by the action of the substrate bearing on the further portion.

According to another aspect of the present invention there is provided a utility pole support member suitable for being securely connected to a utility pole or similar, including an elongate flange portion having a first surface for abutting against the pole in use and an elongate rib portion for providing strength to the pole, the flange portion being connected to the rib portion at respective edges of the flange and rib portions, the flange portion being provided with means for securely connecting the support member to the pole.

In one form of the invention the flanges are curved in accordance with the corresponding curvature of the pole.

In one embodiment, the support member has two flange portions, one located on either side of the rib portion and connected thereto. In another embodiment, the support member is symmetrical about a longitudinal axis extending lengthwise along the centre line of the rib portion. In another embodiment, the rib portion is substantially U-shaped and extends substantially perpendicularly from the extended common curved surface of the two flange portions.

In another embodiment, the elongate rib portion is tapered from a maximum size at its head end in use which is the end of the first portion to a minimum size at its tip end in use which is the end of the second portion. In another embodiment, the flange portions each taper from a maximum width at the head end to a minimum width at their tip. The support member is preferably a large fluted nail arrangement wherein the sides of the flanges of the first portion are parallel and the sides of the flange of the second portion are tapered towards each other in the direction towards their tips.

In another embodiment, one means for securely attaching the support member to the pole comprises a cleat securely located internally of the U-shaped rib portion towards the tip end and a spike wherein the cleat has an angularly inclined engagment portion for cooperatively interacting with the spike which preferably has a corresponding angularly inclined engagement portion so that movement of the support member in the direction towards its tip end in use produces corresponding oblique movement of the spike into the pole to securely locate the support member to the pole.

The cleat and spike, if present, are located below the level of the substrate or below ground level in use, and the spike is tapered from its head to its tip.

The present invention will now be described by way of example with particular reference to the accompanying drawings in which:

FIG. 1(*b*) is a view similar to that of FIG. 1(*a*) illustating one embodiment of the support member being partially forced down into the ground adjacent the pole;

FIG. 1(*c*) is a view similar to FIG. 1(*a*) showing the support member secured to the pole to provide reinforcement for the pole around the rotted portion;

FIGS. 10(*a*) to (*d*) are a series of horizontal cross-sections of the pole showing the spatial relationship of the support member and pole at various distances along the length of the pole.

Figures 1A, 1B, 1C:
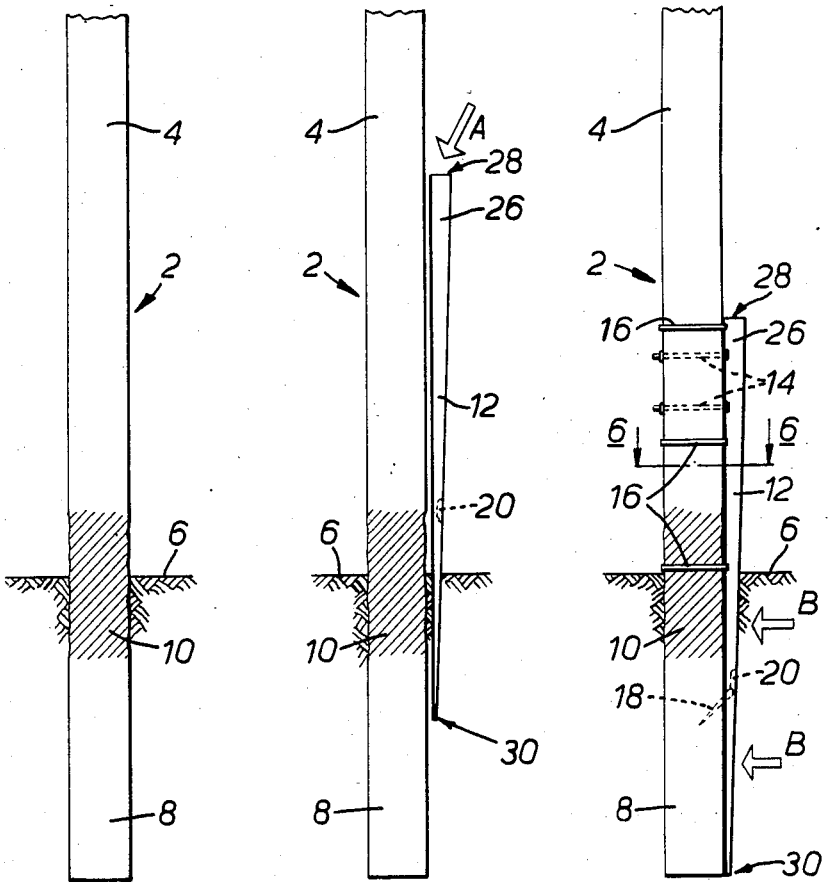
FIG. 1(*a*) illustrates a partial side elevation view of a utility pole located in the ground showing a rotted portion in the region of ground level.
Figure 2:
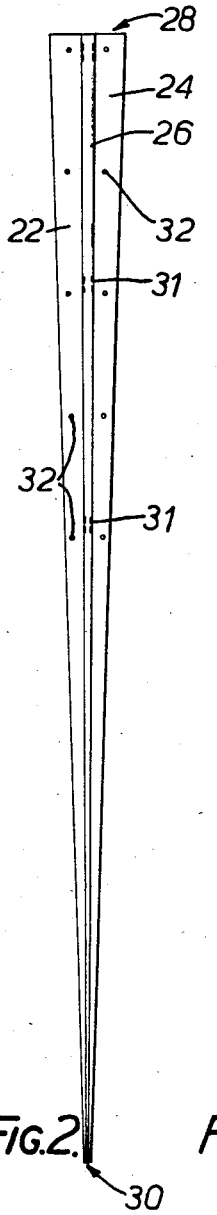
FIG. 2 is a front view of one embodiment of the support member in accordance with the present invention.
Figure 3:
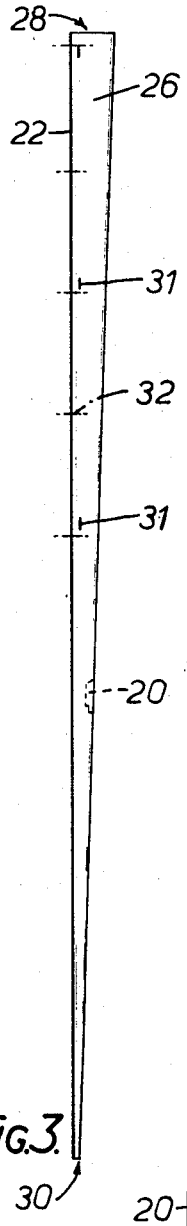
FIG. 3 is a side view of the embodiment shown in FIG. 2.

In the series of FIGS. 1(*a*) to 1(*c*) there is shown a utility pole 2 having a top portion 4 in sound condition above ground level 6, a lower portion 8 in sound condition below ground level, and a middle portion 10 (denoted by the hatching) located about ground level in rotted condition. The rot extends above and below ground level as shown. In FIG. 1(*b*), a support member 12 is shown partially embedded in the ground along side pole 2.

Support member 12 is driven into the ground in the direction of arrow A by any suitable means such as a sledge hammer, pile driver or the like. In FIG. 1(*c*), support member 12 which is shown as being driven into the ground to the required depth alongside pole 2 is securely fixed to the pole by a number of suitable fasteners such as bolts 14 above the ground level 6. Nine such fasteners which may be ¾" bolts are normally used but it is noted that any number of fasteners may be used. Additionally, three stainless steel Gerard strappings 16 are located above ground level to securely fix the support member to the pole. The use of Gerard straps is optional.

Below ground level there is shown a spike 18 driven obliquely into the pole by movement of a cleat 20 in accordance with corresponding movement of the support member in the direction of arrow A. As the support member is securely fixed to the top portion 4 and the lower portion 8 which are both in sound condition, the pole is reinforced about the rotted section 10, and thus is servicable for an extended period.

Turning now the FIGS. 2 to 6 which show the support member 4 in more detail, there is shown a support member having a first flange portion 22 extending lengthwise the extent of the support member separated from a second flange portion 24 also extending lengthwise by a generally U-shaped rib portion 26 having legs 27 and 28 and web portion 29. The flange portions taper respectively from a maximum width at the head end 28 of the support member and to a minimum at their tip end 30. Similarly, as can be seen from FIG. 3, the rib portion projects substantially perpendicularly from the flange surfaces and tapers from a maximum size at the head and to a minimum size at the tip. This embodiment of the support member is essentially a very large fluted nail. The tapering of the rib portion relative to the flange is provided so that when the support member is driven into the ground alongside the pole, the force of the earth compacted around it acts in a direction to force the support member into close contact with the pole as shown by arrows B of FIG. 1(*c*) and therefore the flanges of the support member align substantially parallel to the pole and support the pole over the entire length of the support member. As can be seen from FIG. 6 flanges 22, 24 are curved in accordance with the diameter of the pole to which they are to be attached so that the flange follows the curvature of the pole.

Apertures 32 through which may be driven suitable fasteners such as flat-head nails, clouts or similar, are located at spaced apart intervals along the length of the flange which will be located above the ground level in use. The apertures may be oppositely paired in the flanges i.e. one aperture in one flange is paired with a corresponding aperture in the other flange or they may be alternatively off-set from one another in opposite flanges. In addition, slots 31 are located at spaced apart locations in the rib portion to provide means to further clamp the support member to the pole above ground in use.

Figure 4:
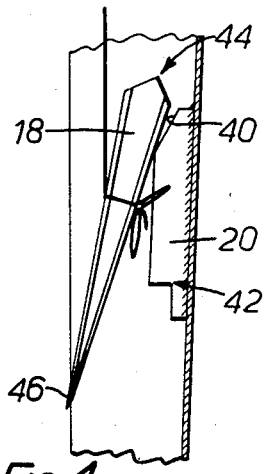
FIG. 4 is a vertical cross-sectional view of one embodiment of a cleat and spike arrangement for securely fixing the support member to the pole showing the spike being lowered into position.

The cleat 20 which is located internally of rib portion 26 towards the tip end 30 is provided for engaging the spike 18. Cleat 20 is provided with a sloping top surface 40 in order that spike 18 when lowered past it will clear the cleat and not be wedged tightly inside the rib in an incorrect position, and a stepped bottom surface 41 as shown in FIG. 4. The stepped bottom surface is comprised of two surfaces arranged at about 90° to each other as an internal corner, and are designed for engagement with the head 43 of the spike. Spike 18 is wedge-like in shape tapering from a maximum width at its head 43 down to a point at its tip 46. The head 43 of the spike is stepped correspondingly to the stepped bottom surface 41 of the cleat i.e. the head of the spike has two surfaces arranged at about 90° to each other as an external corner, so that as the support member is driven further into the ground, the bottom surface 41 engages the head 43 of the spike.

Figure 7:
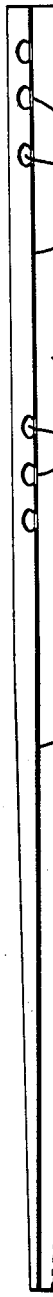
FIG. 7 is a side view of another embodiment of the support member in accordance with the present invention.
Figure 8:
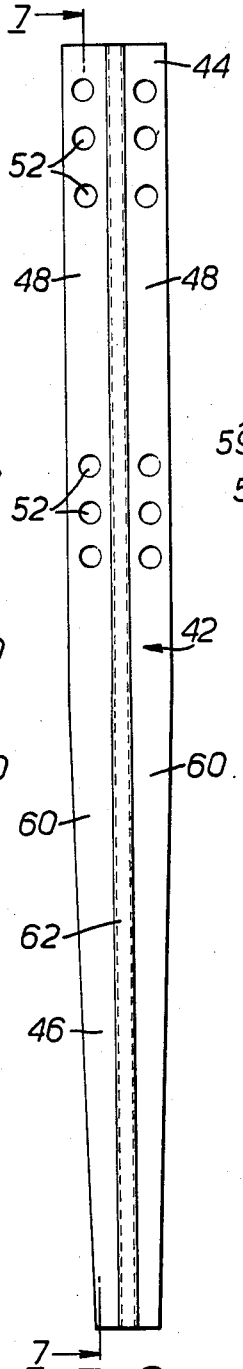
FIG. 8 is a front view of the embodiment shown in FIG. 7.
Figure 9:
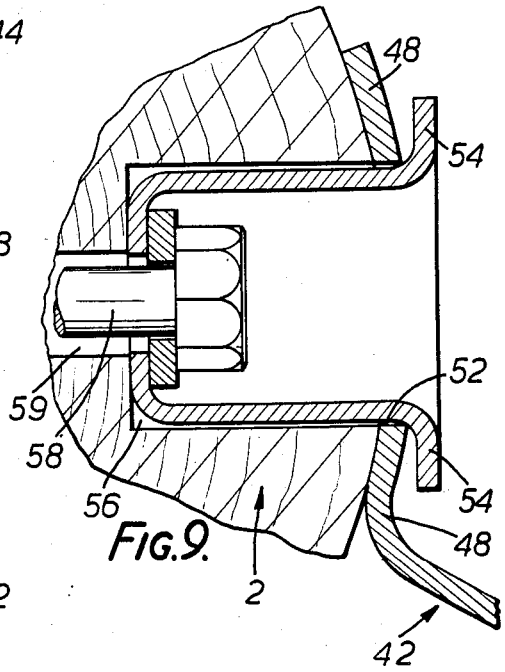
FIG. 9 is a cross-sectional view of one form of the means to secure the support member to the pole above ground level.
Figure 10A:
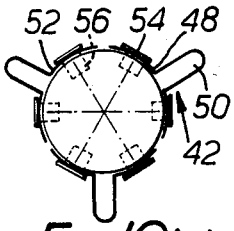
Figure 10B:
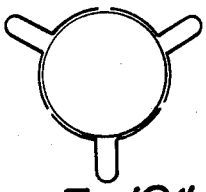
Figure 10C:
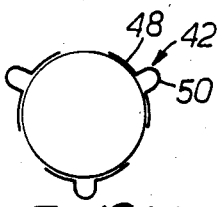
Figure 10D:
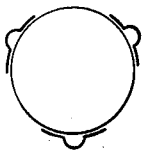

In the embodiment shown in FIGS. 7 to 9, the support member 42 has a top portion 44 and a lower portion 46. Top portion 44 comprises two flanges 48 located on either side of a rib 50 in a similar manner to that of support member 12 described earlier. Apertures 52 are provided in flanges 48 at pre-selected locations for fixing the support member to the pole. One such method of fixing is shown in FIG. 9 and comprises a ferrule 54 of an outside diameter slightly less than the diameter of the apertures 52. Ferrule 54 is located through aperture 52 and is also received in a rebate or cutout 56 located in the outer surface of the pole. A bolt 58 is passed through a bore 59 located in the pole so secure the ferrule in place in the aperture so as to firmly secure the pole support to the pole.

The lower portion 46 of the support member has two flanges 60, one located on either side of centrally placed rib 62 in a similar manner to that described for the top portion 44. However, flanges 60 and rib 62 taper from a point about midway along the length of the support member from a thickness or width at the median of the support member corresponding to the thickness and width of flanges 48 and rib 50 to a very much reduced width and thickness at the tip of the pole support located at the end of lower portion 46. In this embodiment there is no securing means located on the lower portion since the force of the substrate pushing against the rib and flanges of the lower portion keeps the pole support hard against the pole when in the substrate and accordingly provides additional support for the pole to overcome the weakness caused by the damaged or weakened portion.

It is to be noted from FIG. 10(*a*) that when three similar pole supports are used to repair a pole, the supports can be arranged equidistant around the pole so that three bolts only may be used to secure the six flanges. In this arrangement three bores are drilled through the pole along diameters of the pole so that the head of one bolt engages one flange of one support member while the nut applied to the other end of the bolt engages a flange of another member as illustrated.

Figure 5:
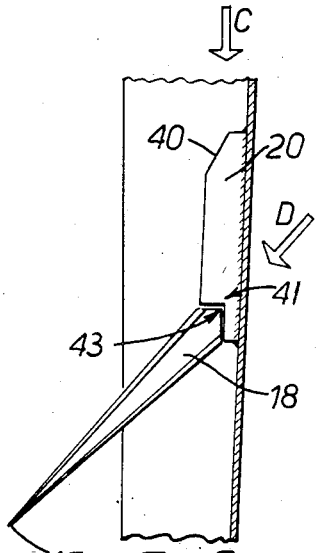
FIG. 5 is a view similar to that of FIG. 4 showing the spike driven home by the action of the cleat.
Figure 6:
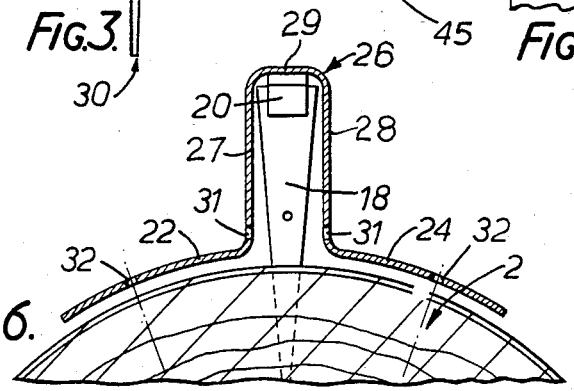
FIG. 6 is a cross-sectional view of the support member along line 6—6 of FIG. 1(*c*).

During installation of the support means against the pole, the support member is first embedded into the ground almost to its final position. While the support member made in accordance with the embodiment of the present invention as shown in FIG. 4 is in this position, spike 18 is lowered down internally of the hollow rib portion until the spike is beneath the cleat 20, then the spike is raised upwardly so that the head 44 can be received against bottom surface 42 and tip 46 is located against pole 2. The support member is then driven further into the ground as shown by arrow C whilst holding spike 18 against the pole to drive tip 46 into the pole. Once the tip of the spike has entered the pole, the support member is forced downwardly into its final position, thereby driving spike obliquely into the pole as shown in FIG. 5 by arrow D to securely locate the support member to the pole below ground level. The arrangement of the stepped bottom surface is so shaped to transfer substantially vertical downwards movement of the support member to a combined sidewards and downwards movement of the spike into the pole.

It is to be noted that any number of similar support members may be used to reinforce a single pole depending on circumstances such as the size of the pole, its weakness, and the size of the support members. Also the size and profile of the flange portions and of the rib portions may be altered in accordance with circumstances such as the number of support members used, their size, weight and the like.

The described arrangement has been advanced merely by way of explanation and many modifications may be made thereto without departing from the spirit and scope of the invention which includes every novel feature and combination of novel features herein disclosed.

I claim:

1. A utility pole support member suitable for being securely connected to a utility pole including at least one elongate flange portion having a first surface for abutting against the pole and an elongate rib portion for providing strengtht to the support member, said support member being provided with means for securely connecting the support member to the pole, said means comprising a ferrule which in use extends into an aperture in the flange portion and into a rebate in the pole and a bolt having a head and shank which shank passes through the pole, the head of the bolt being located within the ferrule.

2. A method of repairing a pole using at least two support members as claimed in claim 1 comprising the steps of driving said support members into ground at opposite sides of the pole such that the flange portions are adjacent to the pole and the ribs project outwardly therefrom:

drilling a hole through the pole and between the apertures in the flanges on opposite sides of the pole;

forming rebates in the pole beneath the apertures;

inserting ferrules in the rebates;

inserting a bolt through the hole so that respective ends of the bolt are located in respective ferrules, and tightening the bolt so that the flanges are firmly clamped against the pole.

3. A utility pole support member as claimed in claim 1 wherein the ferrule comprises a generally cup-shaped body having a cylindrical sidewall having a free end, an end wall with an opening therein and an annular flange extending about the free end of the sidewall, and wherein the sidewall lies in said rebate in the pole and the annular flange engages the flange portion of the support member and wherein the shank of the bolt passes through the opening in the end wall of the ferrule.

4. An elongate support member for provding added strength to a pole, one end of which is buried in ground;

said support member having a top portion, and a bottom portion which in use is driven into the ground;

said support member including first and second flanges and a rib portion, which extend longitudinally of the member, said rib being defined by first and second legs which project from adjacent inner edges of the flanges, and wherein in the bottom portion of the support member the legs taper toward the lower end of the support member whereby the rib portion tapers toward a lower end of the support member wherein, in use, said support member is located adjacent a pole with the flanges adjacent to the pole and driven into the ground whereby reaction of the tapered rib portion with the ground forces the flanges into firm contact with the pole;

said support member being provided with means for connecting the support member to the pole said means comprising ferrules which in use extend into apertures in the flange portions and into rebates in the pole, said means for securely connecting further including bolts each having a head and shank, which shanks pass through the pole, the heads of the bolts being located within the ferrules.

5. A support member as claimed in claim 4 wherein in the bottom portion of the support member the flanges taper in their lateral extend toward the lower end of the support member.

6. A support member as claimed in claim 5 wherein the flanges and rib in the top portion of the support member are tapered without discontinuity with respect to the flanges and rib in the bottom portion of the support member.

7. A support member as claimed in claim 5 wherein the flanges and rib in the top portion are not tapered.

8. A support member as claimed in claim 5 or 6 wherein the flanges and rib are integrally formed from sheet metal.

9. A support member as claimed in claim 8 wherein the flanges are curved in cross-section and lie on a common surface which corresponds to a periphery of the pole.

10. A support member according to claim 8 characterized in that the support member is symmetrical about its center line.

11. A support member according to claim 8 characterized in that the rib portion is substantially U-shaped in cross-section.

12. A support member according to claim 8 in which the lowermost end of the second portion is a tip for entering the ground.

13. A support member according to claim 8 including coupling means for coupling the lower portion of the support member to the pole, said coupling means comprising a cleat securely located internally of the rib portion of the second portion and a spike wherein the cleat has an angularly inclined engagement portion for cooperatively interacting with the spike which has a corresponding angularly inclined engagement portion so that on driving the support member to ground in use produces corresponding oblique movement of the spike into the pole to thereby effect transfer of loads from the top of the pole through the support member to the part of the pole adjacent the spike.

14. A support member according to claim 4 characterized in that the means for fastening the top portion of the support member to the pole is above the level of the ground in use and comprises a ferrule adapted to be received in a rebate located in the pole after passing through an aperture in the support member, said ferrule being fastened to the pole by a bolt having a head and shank so as to clamp the support member securely to the pole.

15. A pole in combination with at least two support members as defined in claim 14 said support members being driven into the ground on opposite sides of the pole and wherein a pair of ferrules on opposite sides of the pole are connected together by the bolt which passes through the pole.

16. A pole as claimed in claim 15 wherein each support member has two of said apertures located in respective first and second flanges, each with respective ferrules and wherein at least two bolts are provided to connect together ferrules which are diametrically opposed relative to the pole.

17. A pole as claimed in claim 16 wherein there are three support members equispaced about the pole.

18. A pole as claimed in claim 17 wherein each support member has a plurality of said apertures in a first group near the top thereof and a plurality of said apertures in a second group thereof located near the lower part of said top portions thereof.

19. An elongate support member for providing added strength to a pole, one end of which is buried in ground;

said support member having a top portion and a bottom portion which in use is driven into the ground;

said support member including first and second flanges and a rib portion, which extends longitudinally of the member, said rib being defined by first and second legs which project from adjacent inner edges of the flanges, and wherein in the bottom portion of the support member the legs taper toward the lower end of the support member whereby the rib portion tapers toward a lower end of the support member wherein, in use, said support member is located adjacent a pole with the flanges adjacent to the pole and driven into the ground whereby reaction of the tapered rib portion with the ground forces the flanges into firm contact with the pole;

said support member further including means to effect fastening of a top portion thereof to the pole after a bottom portion has been driven into the ground;

said support member further characterized in that the means for fastening the top portion of the support member to the pole is above the level of the ground in use and comprises a ferrule adapted to be received in a rebate located in the pole after passing through an aperture in the support member, said ferrule being fastened to the pole by a bolt having a head and shank so as to clmap the support member securely to the pole;

wherein the ferrule comprises a generally cup-shaped body having a cylindrical sidewall having a free end, an end wall with an opening therein and an annular flange extending about the free end of the sidewall, and wherein the sidewall lies in said rebate in the pole and the annular flange engages the flange portion of the support member and wherein the shank of the bolt passes through the opening in the end wall of the ferrule.

* * * * *